US009494374B2

(12) United States Patent
Savitsky et al.

(10) Patent No.: US 9,494,374 B2
(45) Date of Patent: Nov. 15, 2016

(54) FIREARM AND A METHOD FOR LOADING A FIREARM

(71) Applicants: Jeffry Jerome Savitsky, Commerce Township, MI (US); John Michael Garron, South Lyon, MI (US)

(72) Inventors: Jeffry Jerome Savitsky, Commerce Township, MI (US); John Michael Garron, South Lyon, MI (US)

( * ) Notice: Subject to any disclaimer, the term of this patent is extended or adjusted under 35 U.S.C. 154(b) by 0 days.

(21) Appl. No.: 13/986,800

(22) Filed: Jun. 7, 2013

(65) Prior Publication Data

US 2014/0360071 A1 Dec. 11, 2014

(51) Int. Cl.
*F41A 3/66* (2006.01)
*F41C 3/00* (2006.01)

(52) U.S. Cl.
CPC ... *F41A 3/66* (2013.01); *F41C 3/00* (2013.01)

(58) Field of Classification Search
CPC ..... F41A 3/66; F41A 3/18; F41A 3/42; F41C 3/00
USPC ..... 42/71.02, 16; 89/1.4
See application file for complete search history.

(56) References Cited

U.S. PATENT DOCUMENTS

| | | | | |
|---|---|---|---|---|
| 1,680,186 | A * | 8/1928 | Von Frommer | F41A 3/66 42/106 |
| 8,468,734 | B2 * | 6/2013 | Meller | F41A 3/72 42/71.02 |
| D702,308 | S * | 4/2014 | Glock | D22/108 |
| D732,629 | S * | 6/2015 | Wolf | D22/108 |
| 2013/0036642 | A1 * | 2/2013 | Kerbrat | F41A 3/38 42/1.06 |
| 2014/0047753 | A1 * | 2/2014 | Grossman | F41A 3/66 42/72 |
| 2014/0338522 | A1 * | 11/2014 | Bellione | F41A 3/12 89/139 |

* cited by examiner

*Primary Examiner* — Troy Chambers
*Assistant Examiner* — Bridget Cochran
(74) *Attorney, Agent, or Firm* — John G Chupa

(57) ABSTRACT

A firearm 10 having a selectively movable slide portion 12 which includes at least one serrated radius or shoulder edge 14, 16 and which allows the firearm 10 to be selectively cycled by engaging the at least one serrated edge 14, 16 with a surface, such as table edge 32, thereby allowing for selective and relative movement between the frame 7 and the slide portion 12.

1 Claim, 7 Drawing Sheets

FIREARM AND A METHOD FOR LOADING A FIREARM

GENERAL BACKGROUND

1. Field of the Invention

The present invention generally relates to a firearm and to a method for cycling the action of a firearm, and more particularly, to a semi-automatic pistol and to a method for improving the ability to cycle (i.e., the action of clearing, loading or unloading without actually firing) a semi-automatic handgun.

2. Background of the Invention

Firearms have a wide variety of uses, from those associated with sporting activities to personal protection. While a wide variety of firearms exist, such as handguns and rifles, they must all be loaded and unloaded, and at times require the clearing of a bullet remaining lodged in the firearm because the firearm failed to shoot the bullet. That is, typically, a cartridge or magazine of ammunition (bullets) must be selectively placed within a respectively and previously defined location within these respective firearms and the bullets must then be placed or selectively moved into a respective and certain chamber within these respective firearms in order to allow the ammunition to be selectively fired and the bullets propelled or shot from the firearms. The process of selectively and respectively placing the ammunition into these respective chambers is often referred to as "loading" the firearm. The process which is referred to "unloading" or "clearing" the firearm involves removing some or all of the previously placed ammunition without actually firing or shooting the firearms.

Repeating handguns are commonly provided in two varieties, revolvers and semi-automatic type. The semi-automatic types are often cycled, without firing, by the manipulation or use of a movable slide portion, which must be engaged and forcibly moved by the operator of the weapon toward the rear of the handgun (toward the handle) as it is held in one hand of the user.

Generally, to cycle a semi-automatic pistol, the slide must normally be engaged by the other hand of the user, the hand which is not holding the handgun, and the slide must then be selectively moved or manipulated to cycle the pistol. This requires compressing a spring which is operably resident within the semi-automatic pistol. The required compression of the spring therefore can make the slide difficult to move. Thus, should the "free hand" (i.e., the hand used to move the slide) be injured or otherwise occupied, the handgun cannot be cycled in order to load or unload the pistol, or clear the pistol of a malfunction, therefore rendering it either inoperable or unsafe. More particularly, the ammunition cannot be loaded, unloaded or cleared.

Applicant's invention addresses these drawbacks in a new and useful manner and is applicable to any firearm having a slide which must be manipulated for its cycling when it is not actually being fired.

SUMMARY OF THE INVENTION

It is a first non-limiting object of the present invention to provide a firearm which overcomes some or all of the various and previously delineated drawbacks of prior firearms.

It is a second non-limiting object off the present invention to provide a firearm which overcomes some or all of the previously delineated drawbacks of prior firearms and which, by way of example and without limitation, are relatively and easily cycled.

It is a third non-limiting object of the present invention to provide a method for cycling a firearm in an easier and more effective manner, and with a single hand if necessary or desired.

According to a first non-limiting aspect of the present invention, a firearm is provided and includes a selectively movable slide which comprises a smooth broad surface and an edge (radius or shoulder) having a least one engagement portion.

According to a second non-limiting aspect of the present invention, a firearm is provided and includes a selectively movable slide having at least one serrated edge.

According to a third non-limiting aspect of the present invention, a firearm is provided and includes a smooth broad top surface and a pair of opposed and substantially identical serrated edges on the radius, shoulder or edge of the slide.

According to a fourth non-limiting aspect of the present invention, a method is provided for cycling a firearm and which includes the steps of engaging an edge, shoulder or radius of said firearm's slide with a surface; and moving the firearm with the edge of the slide engaged in order to cycle the firearm.

These and other aspects, features, and advantages of the present invention will become apparent from a reading of the following detailed description of the preferred embodiment of the invention, including the subjoined claims, and by reference to the enclosed drawings.

DETAILED DESCRIPTION OF THE PREFERRED EMBODIMENT OF THE INVENTION

Figure 1:
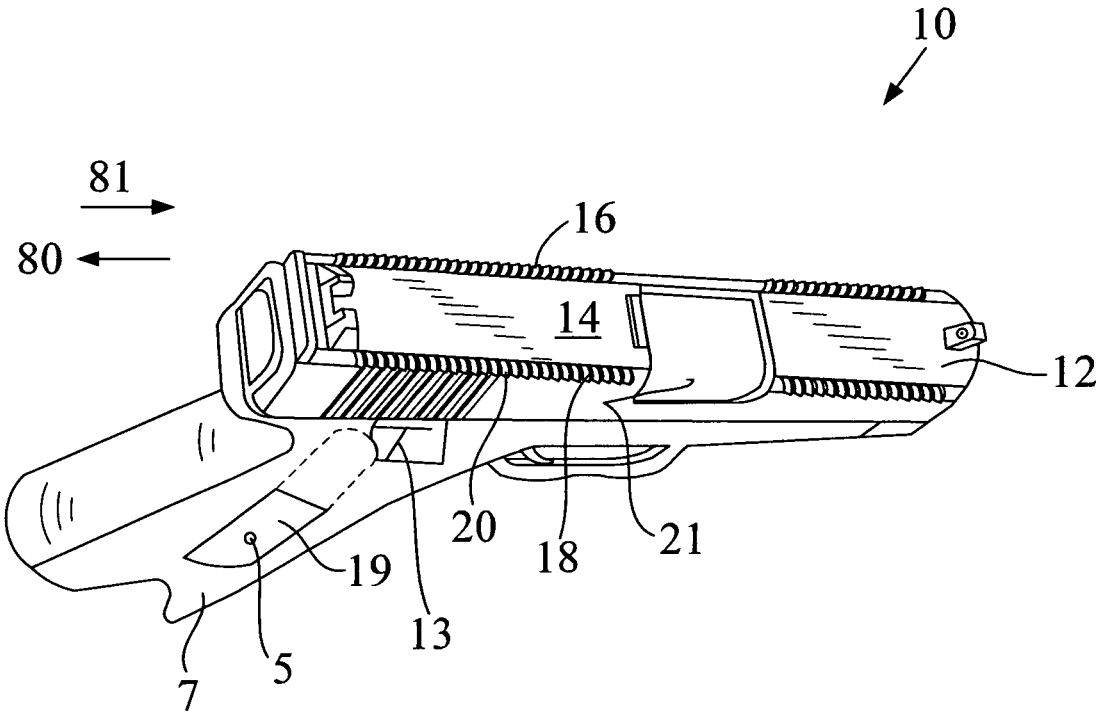
FIG. 1 is a top perspective view of a handgun which is made in accordance with the teachings of the preferred embodiment of the invention.
Figure 2:
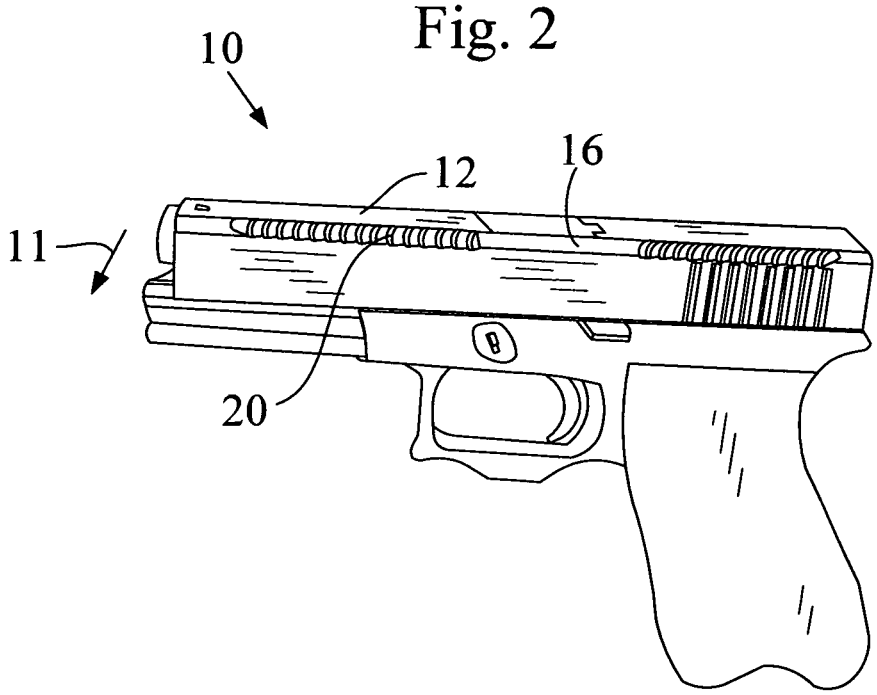
FIG. 2 is a left side view of the handgun which is shown in FIG. 1.
Figure 3:
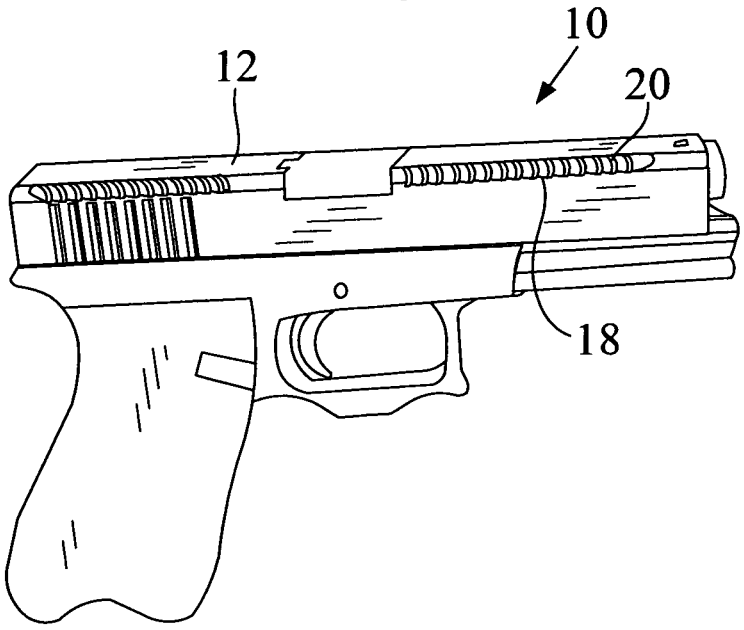
FIG. 3 is a right side view of the handgun which is shown in FIG. 1.
Figure 4:
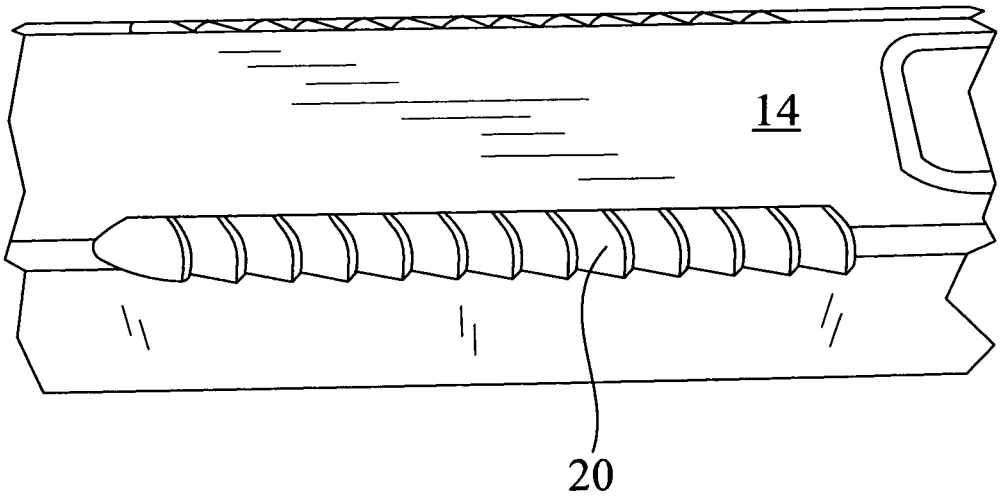
FIG. 4 is a partial exploded top perspective view of the handgun which is shown in FIG. 2.

Referring now to FIGS. 1-4, there is shown a handgun 10 which is made in accordance with the teachings of the preferred embodiment of the invention. It should be appreciated that handgun 10 may comprise a semi-automatic type of pistol or handgun, such as a commercially available Springfield® XD 9 mm handgun or any other type of firearm which requires a selectively movable slide to cycle the gun (e.g., to load, unload or clear it without firing a cartridge).

Particularly, handgun 10 includes a frame or body portion 7 which is coupled to selectively movable slide portion 12 and the portion 12 has a generally broad and smooth top surface portion 14 which terminates into a pair of substantially identical and serrated edges 16, 18 or rounded shoulder portions. Portions 16, 18 are each longitudinally coextensive to the surface 14. In alternate embodiments of the invention, only one such edge 16, 18 is serrated and in other alternate and non-limiting embodiments of the invention, the top surface 14 may be serrated but more commonly will have a generally smooth surface profile. Further, only a respective portion of edges 16, 18 may be serrated.

Particularly, in this most preferred although non-limiting embodiment, each substantially identical edge 16, 18 respectively includes at least one engagement portion or serration 20 which extends in a direction away from the top surface 14. As will be seen below, the at least one engagement portion or serration 20 allows the frame portion 7 to be moved relative to the slide 12 when the slide 12 is made to come into contact with a surface, thereby obviating the need for a hand of a user to move the slide 12. It is the selective and relative movement of the slide 12 to the frame portion 7 which allows the pistol 10 to be selectively cycled.

The slide 12, as is well known to those skilled in the art, is coupled to a spring loading assembly 13, resident within the handgun 10, and a "clip" or magazine of ammunition 19, is selectively and removably placed within the frame 7, a portion of which, upon movement of the slide 12, is caused to be placed within the chamber 21 and thereby being made ready to be fired from the handgun 10. That is, the magazine 19 includes at least one bullet 5 and it should be appreciated that the spring assembly 13 (including the magazine 19) may reside in any desired and operative location within the firearm 10 and are shown in FIG. 1 for illustrative purposes only.

Particularly, as is known, the movement of the slide 12 (which is coupled to spring assembly 13) along direction 80 causes the spring assembly 13 to compress and as the slide 12 is then moved back to its original position, along direction 81, the spring assembly 13 causes a bullet 5, residing within the magazine 19, to be selectively moved into chamber 21 and thereby be ready to be fired. As handguns are generally cycled by pulling the slide 12 with the free hand of the operator towards the rear of the pistol (along direction 80), the serrations 20 shall be cut or made in such a manner and to engage and hold the slide to the engaged object and to allow the frame 7 to move relative to the slide 12 thereby compressing the spring assembly 13 and allowing the handgun 10 to be cycled.

Figure 5:
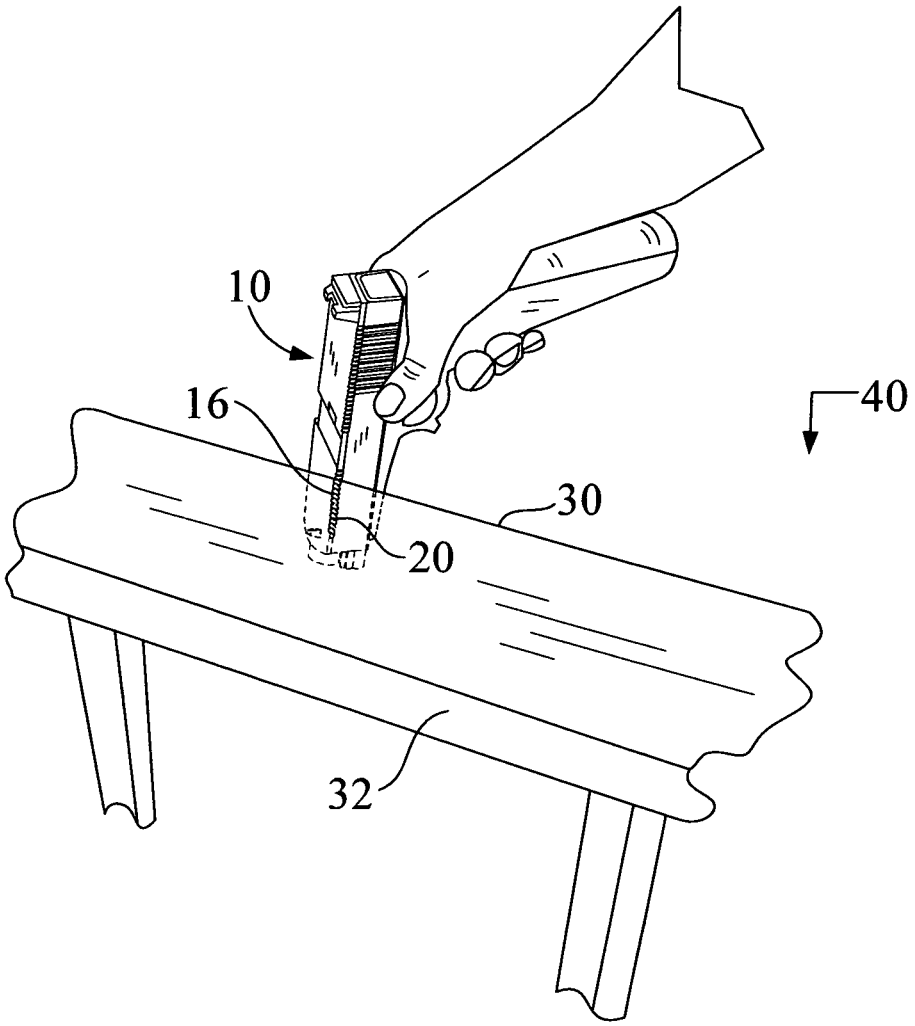
FIG. 5 is a perspective view of the handgun which is shown in FIGS. 1-4 engaging a table according to the methodology of the preferred embodiment of the invention.
Figure 6:
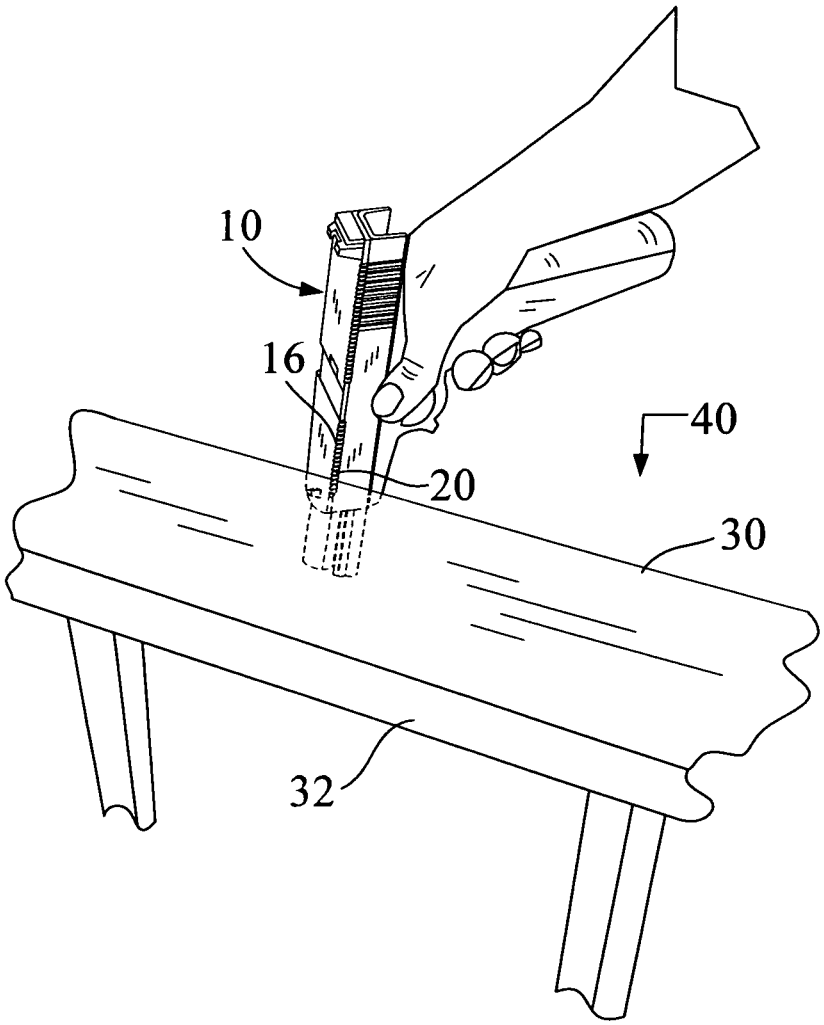
FIG. 6 is a perspective view which is similar to that which is shown in FIG. 5 but further showing movement of the handgun to operate the slide and cycle the pistol as a result of its serrated edge (radius or shoulder) being in contact with the table.

For example, as is perhaps best shown in FIGS. 5-6, the at least one engagement portion 20, which is formed on edge 16, may be made to contact the edge 30 of a table 32. As the contact edge 16 is statically held against the table edge 30, by the engagement of the at least one engagement portion 20 (which is disposed on the edge 16) with the table edge 30, the frame 7 of the handgun 10 is moved in the direction 40, thereby cycling the handgun 10 by causing the spring assembly 13 to be compressed, and when the fame 7 is released from such movement and the edge 16 disengaged from table 30, the gun is cycled (i.e., the spring assembly 13 ejects any bullet 5 which was in the chamber 21 and/or loads a bullet 5 in the chamber 21 if a magazine 19 is resident within the frame 7). In this manner, relative movement between the frame 7 and the slide 12 is achieved.

Figure 7:
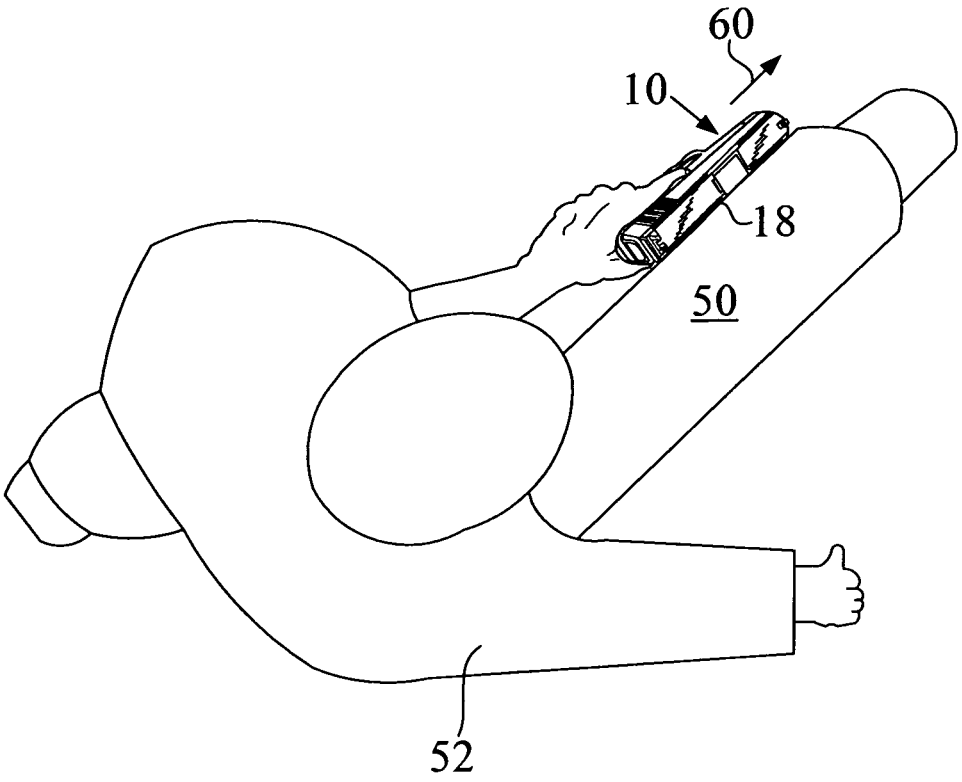
FIG. 7 is a perspective view of the handgun which is shown in FIGS. 1-4 engaging the leg of a user according to the methodology of the preferred embodiment of the invention.
Figure 8:
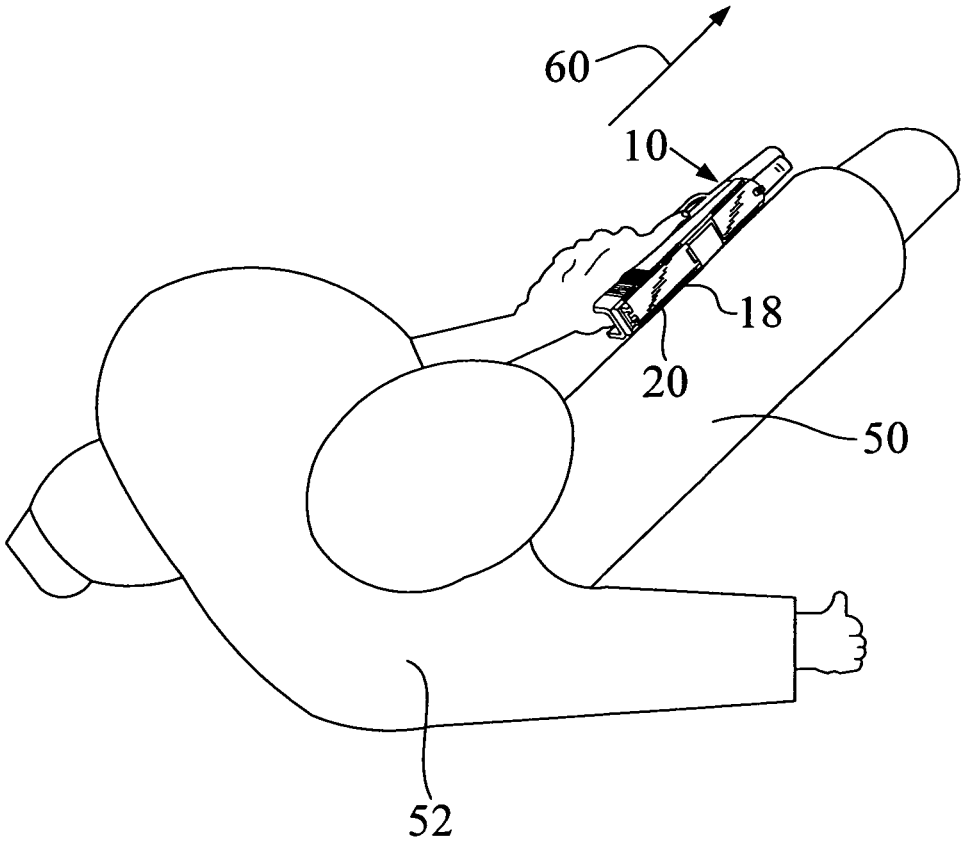
FIG. 8 is a perspective view which is similar to that which is shown in FIG. 7 but further showing the operation of the slide to cycle the pistol as a result of the serrated edge of the slide with the leg of the user.

By way of a second non-limiting example, as is perhaps best shown in FIGS. 7-8, the at least one engagement portion 20, which is formed on edge 18, may be made to contact the leg 50 of the user 52 and moved in the direction 60. As the contact edge 14 is engaged and held against the leg 50, the frame 7 of the pistol is moved in the direction 60, (thereby causing the spring assembly 13 to be compressed) and when the frame 7 is released from such movement and the edge 18 disengaged from leg 50, the handgun 10 is cycled. That is, the frame 7, when moved in direction 60, compresses the spring assembly 13 and when the handgun 10 is released from contact with leg 50, the handgun 10 is cycled in the foregoing described manner. In this manner, relative movement between the frame 7 and the slide 12 is achieved.

It should thus be apparent that the at least one serrated edge 14, 16 allows the handgun 10 to be loaded and/or cleared without the use of the free hand of the user 52 and thereby overcomes the previously delineated drawbacks of firearms. Moreover, the invention may be applied to any type of firearm or weapon and not only to a handgun. It should be further appreciated that at least one engagement portion 20 may be of any desired shape and size, and must project away from the edge 14, 16 that is deployed upon and must concomitantly project away from the surface 14. Instead of individual engagement portions, the edges 14 and/or 16 may have respective other surface patterns or treatments to increase the friction of the slide with the contacted surface thereby allowing the pistol to be cycled. It should be apparent that at least one serration 20 provides for relative movement of the frame 7 and slide 12 sufficient to selectively compress and then decompress the spring assembly 13 in order to selectively cycle the handgun 10.

It is to be understood that the present inventions are not limited to the exact construction or methodology which has been delineated above, but that various changes and modifications may be made without departing from the spirit and the scope of the inventions as they are delineated in the following claims.

What is claimed is:

1. A firearm having a slide portion which has a top surface having opposed shoulder edges which are each linearly co-extensive and longitudinally co-extensive to said top surface and wherein said firearm further includes a plurality of substantially identical engagement portions which are disposed only upon one of said opposed shoulder edges and which project away from said opposed shoulder edges.

* * * * *